US008100728B2

(12) United States Patent
Yeh et al.

(10) Patent No.: US 8,100,728 B2
(45) Date of Patent: Jan. 24, 2012

(54) CONNECTOR ASSEMBLY

(75) Inventors: Chin-Wen Yeh, Taipei Hsien (TW); Zhi-Jian Peng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/697,220

(22) Filed: Jan. 30, 2010

(65) Prior Publication Data

US 2011/0086535 A1 Apr. 14, 2011

(30) Foreign Application Priority Data

Oct. 14, 2009 (CN) ..... 2009 2 0312456 U

(51) Int. Cl.
*H01R 13/502* (2006.01)

(52) U.S. Cl. ..... 439/701; 439/717

(58) Field of Classification Search ..... 439/701, 439/717
See application file for complete search history.

(56) References Cited

U.S. PATENT DOCUMENTS 4,820,169 A * 4/1989 Weber et al. ..... 439/65
5,775,953 A * 7/1998 Yamanashi et al. ..... 439/701

* cited by examiner

*Primary Examiner* — Ross Gushi
(74) *Attorney, Agent, or Firm* — Altis Law Group, Inc.

(57) ABSTRACT

A connector assembly includes a first male connector, a second male connector, and a female connector. The female connector defines two receiving slots side by side. The first male connector includes a first body, a first inserting terminal, extending downwardly from the first body, and a first securing portion. The first inserting terminal engages one of the receiving slots of the female connecter. The second male connector includes a second body; a second inserting terminal, extending downwardly from the second body; and a second securing portion, engaging the slot of the first male connector. The second inserting terminal engages the other one of the receiving slots of the female connecter.

9 Claims, 4 Drawing Sheets

CONNECTOR ASSEMBLY

BACKGROUND

1. Technical Field

The disclosure generally relates to connector assemblies, especially to a male connector having a securing portion for engaging with another male connector.

2. Description of Related Art

For transmitting signals between two electronic components, a male connector and a female connector are generally employed. Sometimes a male connector and a female connector are not tightly connected due to lack of sufficient engagement between the male connector and the female connector. This can affect the quality of transmitting signals transmitted between the male connector and the female connector.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
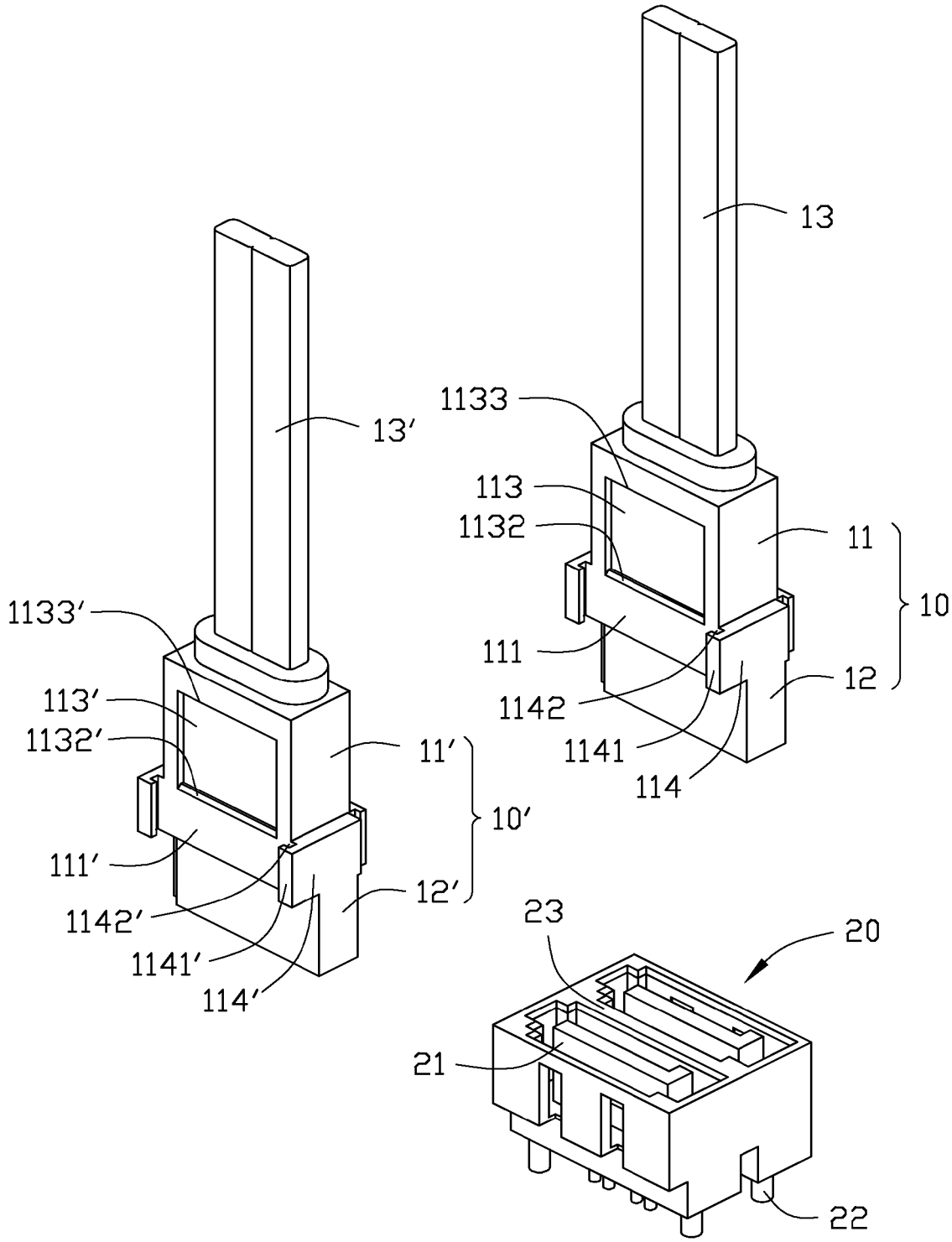
FIG. 1 is an exploded, isometric view of a SATA connector assembly of an embodiment.
Figure 2:
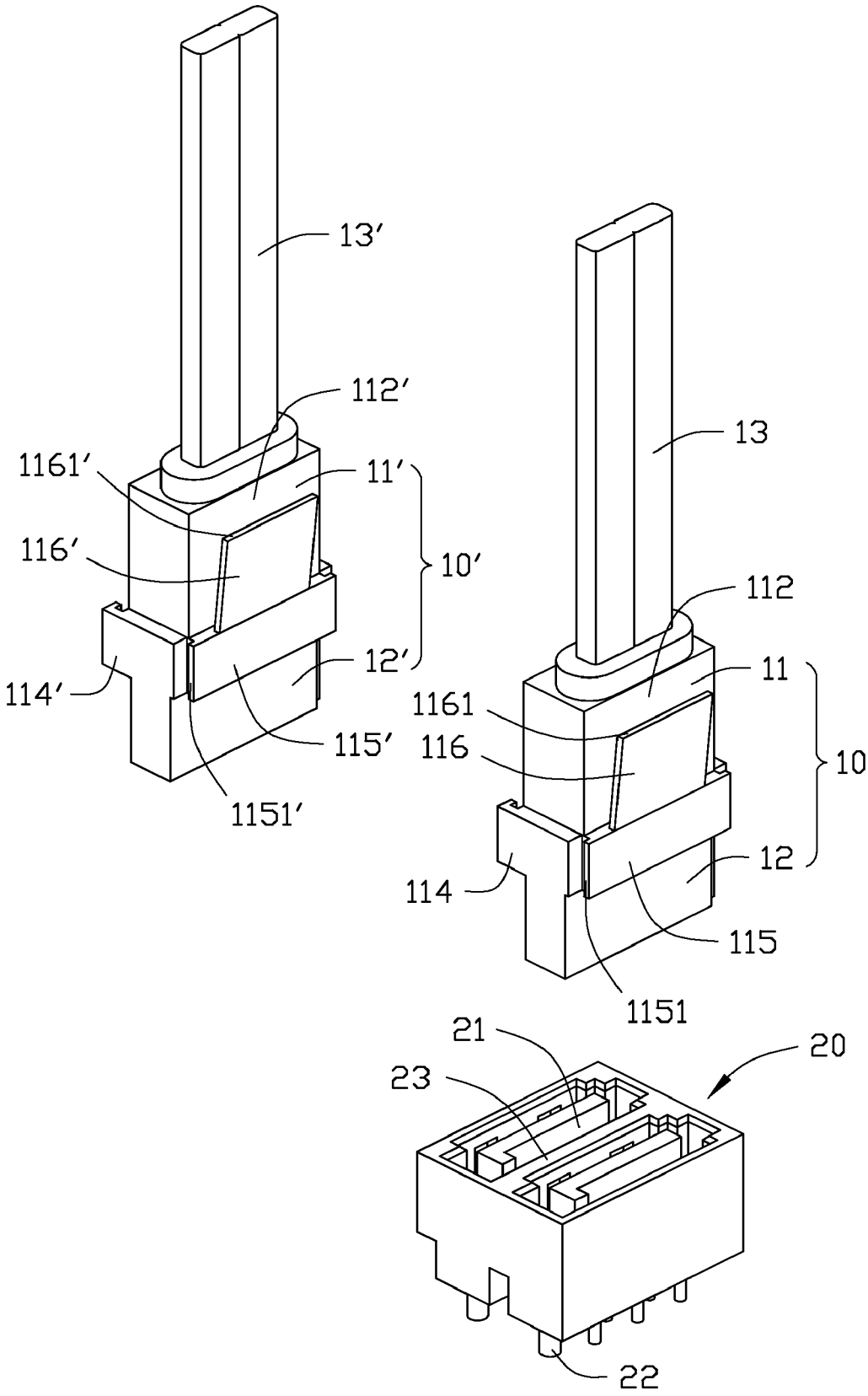
FIG. 2 is similar to FIG. 1, but viewed from another aspect.
Figure 3:
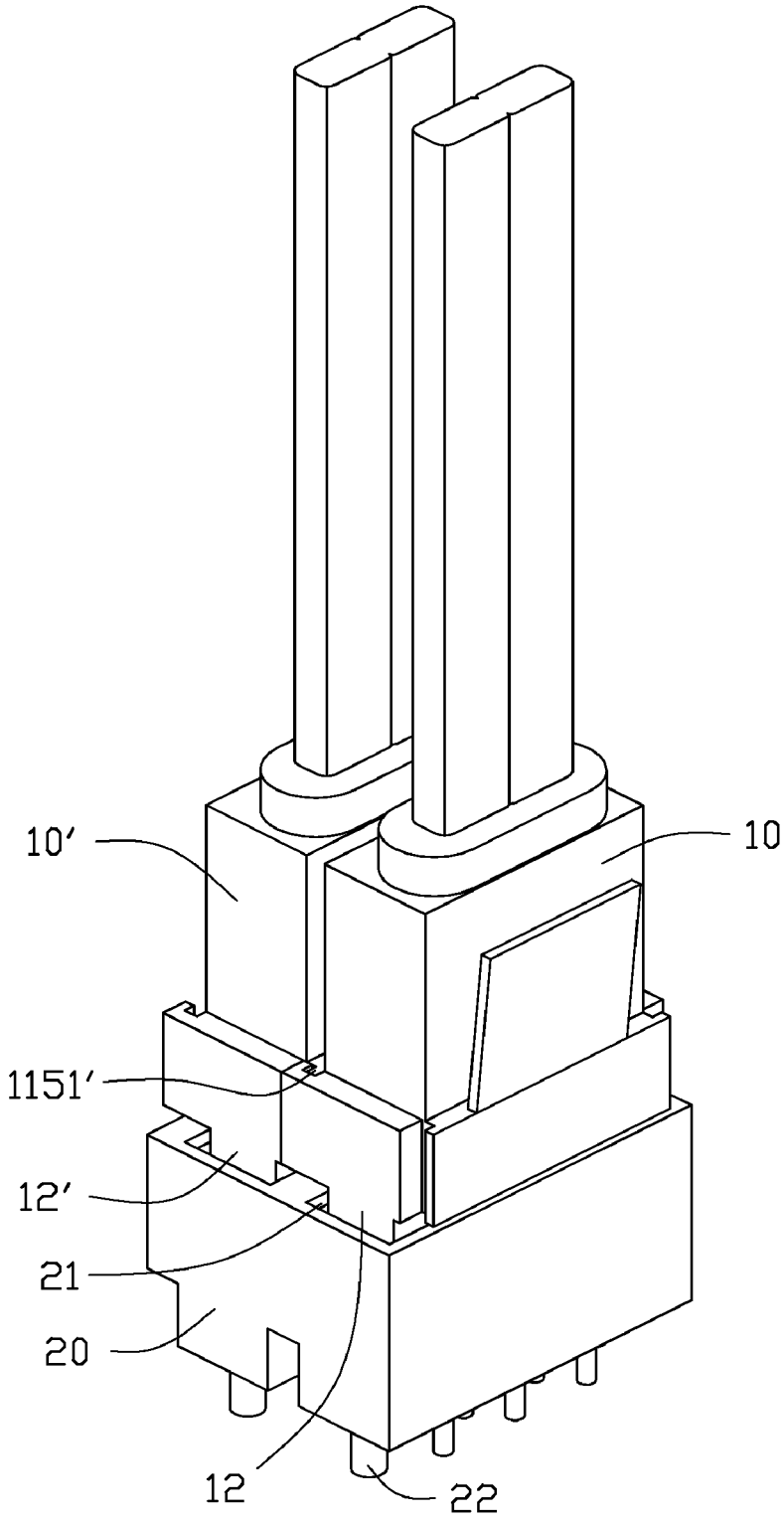
FIG. 3 is an assembly view of FIG. 2.
Figure 4:
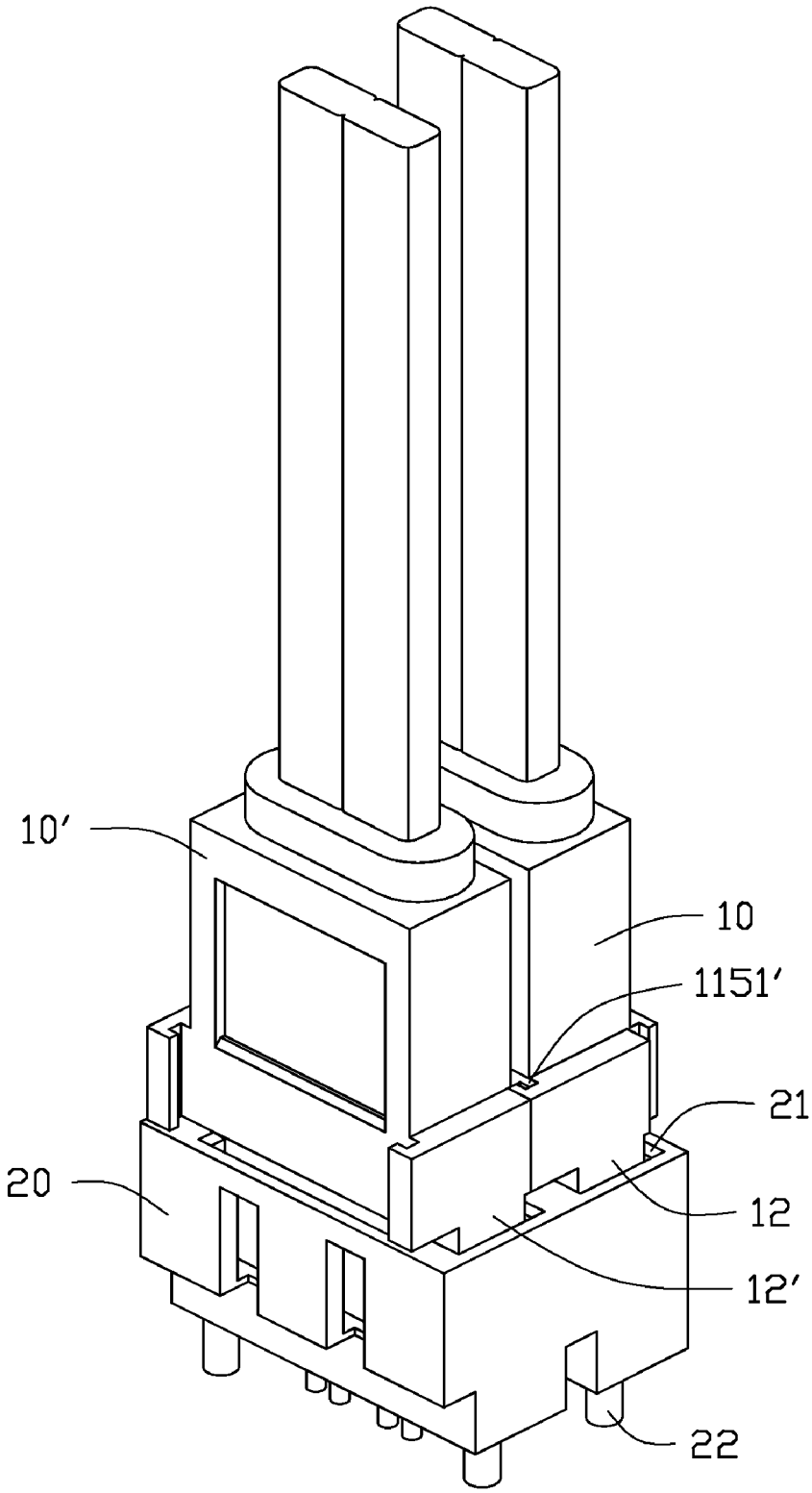
FIG. 4 is an assembly view of FIG. 1.

Referring to FIGS. 1 and 2, a SATA connector assembly includes a first SATA male connector 10, a second SATA male connector 10', and a female connector 20. The first and second SATA male connector 10, 10' may have same structure.

The first SATA male connector 10 includes a first body 11 and a first inserting terminal 12 extending from one end of the first body 11. A SATA signal line 13 extends from another end of the first body 11 opposite to the end of the body 11.

The first body 11 defines a first side surface 111 and a second side surface 112 opposite to the first side surface 111. The first side surface 111 is parallel to the second side surface 112. The first side surface 111 defines a recess 113. The recess 113 defines an oblique surface 1132 and a resisting surface 1133. The first body 11 includes two first securing portions 114 at two opposite sides of the first body 11. Each first securing portion 114 includes an L-shaped receiving portion 1141 extending from the first side surface 111. A securing slot 1142 is defined by the receiving portion 1141 and the first side surface 111. The first body 11 includes a second securing portion 115 extending from the second side surface 112. The second securing portion 115 includes two protrusions 1151 extending from two opposite side edges of the second securing portion 115 and a resilient securing tab 116 corresponding to the recess 113. The securing tab 116 extends diagonally from a top edge of the second securing portion 115. The securing tab 116 defines a resisting edge 1161 at a distal end of the securing tab 116.

The second SATA male connector 10' includes a second body 11' and an inserting terminal 12' extending from one end of the second body 11'. A SATA signal line 13' extends from another end of the second body 11' opposite to the end of the second body 11'.

The second body 11' defines a first side surface 111' and a second side surface 112' opposite to the first side surface 111'. The first side surface 111' is parallel to the second side surface 112'. The first side surface 111' defines a recess 113'. The recess 113' defines an oblique surface 1132' and a resisting surface 1133'. The second body 11' includes two first securing portions 114' at two opposite sides of the second body 11'. Each first securing portion 114' includes an L-shaped receiving portion 1141' extending from the first side surface 111'. A securing slot 1142' is defined by the receiving portion 1141' and the first side surface 111'. The second body 11' includes a second securing portion 115' extending from the second side surface 112'. The second securing portion 115' includes two protrusions 1151' extending from two opposite side edges of the second securing portion 115' and a securing tab 116' corresponding to the receiving portion 113'. The securing tab 116' extends diagonally from a top edge of the second securing portion 115'. The securing tab 116' defines a resisting edge 1161' at a distal end of the securing tab 116'.

The SATA female connector 20 defines two receiving slots 21 for receiving the first and second SATA male connector 10, 10' respectively and a plurality of securing protrusion 22 for securing the SATA female connector 20 to a printed circuit board (not shown). The two receiving slots 21 are separated via a separating plate 23.

Referring to FIGS. 1 to 4, in assembly, the second SATA male connector 10' is inserted into one corresponding receiving slot 21. The two securing slots 1142 of the first SATA male connector 10 are aligned with the two protrusions 1151' of the second SATA male connector 10'. At this time, the recess 113 of the first SATA male connector 10 corresponds with the securing tab 116' of the second male connector 10', and the inserting terminal 12 of the first SATA male connector 10 is aligned with the other receiving slot 21 of the SATA female connector 20. When the first SATA male connector 10 is moved downwardly, the securing tab 116' is moved into the recess 113 of the first SATA male connector 10 via the oblique surface 1132 and the resisting edge 1161' resisting against the resisting surface 1133 of the recess 113. The securing slots 1142 of the first SATA male connector 10 engage with the two protrusions 1151' of the second male connector 10' respectively. The inserting terminal 12 of the first SATA male connector 10 is inserted into the corresponding receiving slot 21 of the SATA female connector 20.

In disassembly, the first SATA male connector 10 is moved upwardly to enable the securing slots 1142 to disengage with the two protrusions 1151', thereby separating the first SATA male connector 10 from the second SATA male connector 10'.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A connector assembly, comprising:

a female connector defining two receiving slots side by side;

a first male connector comprising a first body and a first inserting terminal extending downwardly from the first body, the first body defining a first side surface, the first inserting terminal engages one of the two receiving slots of the female connecter, the first body comprising a first securing portion, the first securing portion comprising an L-shaped receiving portion extending from the first side surface; and a second male connector comprising a second body and a second inserting terminal extending downwardly from the second body, the second inserting terminal engages the other one of the receiving slots of the female connecter, the second body comprising a second securing portion;

wherein a securing slot is defined between the L-shaped receiving portion and the first side surface; and the second securing portion comprises a protrusion slidably mounted in the securing slot; the first male connector further comprises another first securing portion; the first side surface defines a recess between the first securing portion and the another first securing portion, and the second male connector comprises a resilient securing tab to engage with the recess; the recess defines an oblique surface configured to guide the securing tab to slide into the recess.

2. A male connector, comprising:

a body defining a first side surface and a second side surface opposite to the second side surface, the body comprising two first securing portions on the first surface and a second securing portion on the second side surface, the second securing portion comprising opposite ends configured to accommodate the two first securing portions; and an inserting terminal extending downwardly from one end of the body, the inserting terminal configured to insert into a female connector;

wherein the first side surface defines a recess between the two first securing portions, and the body comprises a resilient securing tab extending diagonally from the second side surface configured to accommodate the recess.

3. The male connector of claim 2, wherein the recess defines an oblique surface.

4. The male connector of claim 3, wherein the recess defines a resisting surface opposite to the oblique surface.

5. The male connector of claim 2, wherein each first securing portion defines a securing slot, and the second securing portion comprises two protrusions configured to accommodate the two securing slots of the two first securing portions.

6. The male connector of claim 5, wherein each first securing portion comprises an L-shaped receiving portion, and the securing slot is defined in the receiving portion.

7. The male connector of claim 2, wherein the first side surface is parallel to the second side surface.

8. The male connector of claim 2, wherein the male connector is a SATA type connector.

9. A connector assembly, comprising:

a female connector defining two receiving slots side by side;

a first male connector comprising a first body and a first inserting terminal extending downwardly from the first body, the first inserting terminal engages one of the two receiving slots of the female connecter, the first body defining a first side surface, the first body comprising two first securing portions extending from the first side surface; and a second male connector comprising a second body and a second inserting terminal extending downwardly from the second body, the second inserting terminal engages the other one of the receiving slots of the female connecter, the second body defining a second side surface; the second body comprising a second securing portion extending from the second side surface; opposite ends of the second securing portion slidably mounted in the two first securing portions respectively;

wherein each first securing portion defines a securing slot; and the second securing portion comprises two protrusions at the opposite ends slidably mounted in the two securing slots respectively; the first male connector side surface defines a recess between the two first securing portions, and the second male connector comprises a resilient securing tab to engage with the recess.

* * * * *